United States Patent [19]

Kato et al.

[11] Patent Number: 4,921,622

[45] Date of Patent: May 1, 1990

[54] FLUID-PERMEABLE AGENT FOR NON-WOVEN SHEETS OF POLYOLEFIN FIBERS AND METHOD OF APPLICATION THEREOF: N,N-DI-HYDROXYETHYL AMIDE AND POLYOXYALKYLENE-MODIFIED SILICONE

[75] Inventors: Tomohiro Kato; Yoshio Takasu; Makoto Minafuji, all of Aichi, Japan

[73] Assignee: Takemoto Yushi Kabushiki Kaisha, Aichi, Japan

[21] Appl. No.: 272,730

[22] Filed: Nov. 17, 1988

[30] Foreign Application Priority Data

Dec. 2, 1987 [JP] Japan ..... 62-305326

[51] Int. Cl.[5] ..... D06M 13/40; D06M 15/64

[52] U.S. Cl. ..... 252/8.9; 252/8.6; 252/8.8; 8/115.54; 8/115.64

[58] Field of Search ..... 252/8.8, 8.9; 8/115.64

[56] References Cited

U.S. PATENT DOCUMENTS 4,552,671 11/1985 Ogiso et al. ..... 252/8.9
4,561,987 12/1985 Yamamoto et al. ..... 252/8.9

FOREIGN PATENT DOCUMENTS 01-0006176 1/1989 Japan .
01-148879 6/1989 Japan .

*Primary Examiner*—A. Lionel Clingman
*Attorney, Agent, or Firm*—Flehr, Hohbach, Test, Albritton & Herbert

[57] ABSTRACT

A fluid-permeable agent for providing fluid-permeability to non-woven sheets of polyolefin fibers contains 50–95 wt % of aliphatic diethanol amide shown by Formula (A) given below and 5–50 wt % of polyoxyalkylene modified silicone shown by Formula (B) given below:

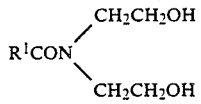

(A)

where $R^1$ is alkyl or alkenyl group with 11–17 carbon atoms; and

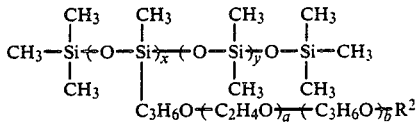

(B)

where x is an integer in the range of 1–10, y is an integer in the range of 7–100, a is an integer equal to or greater than 5, b is an integer equal to or less than 95, (a+b) is an integer equal to or less than 100 and $R_2$ is H or alkyl group with 1–12 carbon atoms. The agent may additionally contain nonionic surfactants and salt of certain specified kinds and is applied at a rate of 0.1–5.0 wt % with respect to the fibers for good results.

12 Claims, No Drawings

FLUID-PERMEABLE AGENT FOR NON-WOVEN SHEETS OF POLYOLEFIN FIBERS AND METHOD OF APPLICATION THEREOF: N,N-DI-HYDROXYETHYL AMIDE AND POLYOXYALKYLENE-MODIFIED SILICONE

BACKGROUND OF THE INVENTION

This invention relates to fluid-permeable agents for non-woven sheets made of polyolefin fibers such as composite synthetic fibers having sheath-core structure made of two or more polymers with different melting points having polyolefin polymer sheaths and also to application methods of such agents. More particularly, this invention relates to agents to be applied to such fibers for providing durability and fluid-permeability and also to methods of applying such agents.

Recently, non-woven sheets by a dry-bonding process and more particularly bondable non-woven sheets are coming to be frequently used in medical supplies and hygienical articles. For diapers, napkins and the like, polyolefin fibers and composite polyethylene fibers are frequently used in view of their skin-comfortability (that is, softness and absence of discomfort from wetting). In order to improve product characteristics such as bulkiness, restorability and shape-stability against heat, on the other hand, use is frequently made of heat-bondable composite fibers comprised of polyester fibers and polypropylene fibers as the core and polyolefin polymers as the sheath.

In order to eliminate user's discomfort from a diaper, a napkin and the like caused by sweat, urine, menstrual fluid and other body fluids, it is considered important not only that the body-facing parts of these products be wettable but also their wettability can be quickly manifested. For this reason, fluid-permeability within a short time is a required characteristic of polyolefin fibers of which these body-facing parts are comprised. Since diapers, in particular, are generally worn by infants, seniors and very sick persons who cannot take care of themselves, a single diaper should be able to handle two or more discharges without causing discomfort to the wearer. For this reason, durability of fluid-permeability (or durability against repeated use) is another strongly required characteristic.

Prior art methods of providing fluid-permeability to polyolefin fibers and composite fibers with polyolefin sheaths include (1) application of a low-molecular weight hydrophilic compound, (2) application of a hydrophilic macromolecular resin, (3) improvement of surface characteristics by chemical processing, solvent processing, plasma processing, corona discharge processing, etc. By the first of the above methods, however, not only desired fluid-permeability cannot be obtained because these agents cannot wet the fiber surface satisfactorily but also there is no durability even if fluid-permeability can be obtained to a certain extent and, in many instances, the user's skin is seriously irritated. The second of the above methods, on the other hand, generally cannot provide sufficient fluid-permeability. Additional disadvantages include insufficiency in durability if use is made of an agent which can provide fluid-permeability to a certain extent. Moreover, agents of this type have the tendency of causing troubles of various kinds during the production process of non-woven sheets. As for the third of the above methods, although it provides relatively favorable results regarding skin-irritation and permeability, resultant fluid-permeability tends to deteriorate with time along with the polar groups which are generated by the surface changes of the fibers. In other words, this method not only provides insufficient durability but also is itself uneconomical.

There have been proposals, on the other hand, to use a hydrophilic polymer as base material and to partially coat its surface with a hydrophobic compound. A water repellant polymer may be used as the hydrophobic compound as disclosed in U.S. Pat. No. 3,934,587. Alternatively, use may be made of a compound of silicon or fluorine as disclosed in U.S. Pat. No. 3,838,692. These proposed methods are equally unsatisfactory because a basically hydrophilic polymer is used as the base material and the aforementioned characteristics of basically hydrophobic polyolefin fibers are lacking.

SUMMARY OF THE INVENTION

Polyolefin fibers being basically very poor in permeability because of their low surface energy characteristics, it is an object of the present invention to provide fluid-permeable agents for nonwoven sheets of polyolefin fibers with which the aforementioned problems of prior art agents can be eliminated.

The present invention has been completed by the present inventors as a result of their diligent studies in view of the aforementioned and other objects and is based on their discovery that desired results are obtainable by agents containing specified amounts of specified kinds of aliphatic diethanol amide and polyoxyalkylene modified silicone and also by those additionally containing a specified kind of surfactant appropriately selected for the purpose.

DETAILED DESCRIPTION OF THE INVENTION

Fluid-permeable agents according to the present invention for non-woven sheets of polyolefin fibers are characterized as containing 50–95 wt% of aliphatic diethanol amide shown by Formula (A) given below and 5–50 wt% of polyoxyalkylene modified silicone shown by Formula (B) given below:

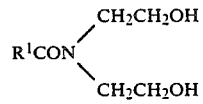

(A)

where $R^1$ is alkyl or alkenyl group with 11–17 carbon atoms; and

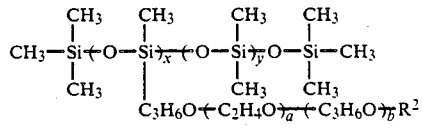

(B)

where x is an integer in the range of 1–10, y is an integer in the range of 7–100, a is an integer equal to or greater than 5, b is an integer equal to or less than 95, (a+b) is an integer equal to or less than 100 and $R^2$ is H or alkyl group with 1–12 carbon atoms.

Aliphatic diethanol amides shown by the formula above are compounds which are obtainable generally by reaction between methyl ester of aliphatic acid and diethanol amine. They may be called (1:1) type alkylol amide or (1:2) type alkylol amide, depending on the conditions of the reaction, but their principal constituent is a compound of the structure shown by the formula above.

Regarding the aliphatic diethanol amides described above, the residue of aliphatic acid (or $R^1$) is limited to alkyl or alkenyl group with 11–17 carbon atoms. With alkyl group or alkenyl group with 18 or more carbon atoms, the resultant aliphatic diethanol amide is less soluble or nearly insoluble in water and not only is it impossible to obtain a stable solution of the agent but a non-woven sheet treated with such an agent does not acquire sufficient permeability. If the alkyl or alkenyl group has less than 11 carbon atoms, on the other hand, durability of processed non-woven sheets becomes extremely poor. If aliphatic diethanol amide is contained by less than 50 wt%, furthermore, both permeability and durability of the processed nonwoven sheets become extremely poor.

Polyoxyalkylene modified silicones shown by Formula (B) above are modified silicones which are obtainable by adding monoallylether of (1) polyethylene glycol,
(2) block or random copolymer polyether of polyethylene glycol and polypropylene glycol,
(3) an adduct of ethylene oxide to an alcohol with 1–12 carbon atoms, or
(4) a block or random adduct of propylene oxide/ethylene oxide to an alcohol with 1–12 carbon atoms to dimethyl hydrogen polysiloxane.

Polyoxyalkylene modified silicones of the present invention are characterized by their small water solubility because of their structure. Their solubility is such that they can be emulsified barely with the help of an emulsifier. In fact, the integer x in Formula (B) must be 1 or greater in order to obtain satisfactory fluid-permeability by providing a minimum of water solubility to the obtained modified silicone, but if x is greater than 10, on the other hand, water solubility of the obtained modified silicone becomes too large and, although its fluid-permeability may be satisfactory, its durability becomes insufficient. Similarly, the integer a in Formula (B) must be 5 or greater in order to obtain satisfactory fluid-permeability by providing a minimum of water solubility to the obtained modified silicone, but if (a+b) is greater than 100, durability of the obtained modified silicone, in particular, is significantly affected. In this regard, the molar ratio and the weight ratio of the polyoxyethylene part indicated together by a and the polyoxypropylene part indicated together by b is also influential and the ratio $(a\times44)/(b\times58)$ should preferably be greater than 25/75. If $R^2$ in Formula (B) is an alkyl group with 12 or more carbon atoms, furthermore, fluid-permeability of the obtained modified silicone is insufficient. If the integer y in Formula (B) is smaller than 7, durability of the obtained modified silicone is poor and if it is greater than 100, on the other hand, fluid-permeability is adversely affected.

In summary, agents according to the present invention are characterized as containing aliphatic diethanol amide and polyoxyalkylene modified silicone of the types described above at a weight ratio in the range of 50–95/50–5. If aliphatic diethanol amide is contained by less than 50 wt%, it is impossible to obtain sufficient fluid-permeability and durability and if polyoxyalkylene modified silicone is contained by less than 5 wt%, it is also impossible to obtain sufficient fluid-permeability. Only if they are both contained at a ratio within the range given above, agents with far superior fluid-permeability and durability can be obtained as compared when they are used singly.

The agent of the present invention may be used in combination with a surfactant of specified kinds in order to improve the characteristics related to the production processes of non-woven sheets without adversely affecting the aforementioned permeability and durability characteristics of aliphatic diethanol amide and polyoxyalkylene modified silicone. Among preferable surfactants are nonionic surfactants having alkyl or alkenyl group with 11–22 carbon atoms and 3–10 moles of ethylene oxide or propylene oxide added per functional group.

With a nonionic surfactant having alkyl or alkenyl group with less than 11 carbon atoms, the agent is not uniformly attached to fibers and both its fluid-permeability and durability become poor. The result is approximately the same if the number of carbon atoms exceeds 22. If less than 3 moles of alkylene oxide is added, both solubility into water and stability of solution become poor and abnormal attachment to fibers may occur such that fluid-permeability becomes poorer. If more than 10 moles of alkylene oxide is added, on the other hand, durability of aliphatic diethanol amide and polyoxyalkylene modified silicone is affected.

Examples of preferable nonionic surfactant include POE(7) stearyl ether, POE(5) oleyl ether, PEG(400) stearate, POE(10) lauryl ether stearate, POE(4) cetyl amino ether, POE(7) stearoyl amino ether, ethylene oxide (7 moles) adduct of sorbitan monostearate, ethylene oxide (9 moles) adduct of trimethylol propane tristearate, ethylene oxide (10 moles) adduct of pentaerythritol distearate, trioleate of ethylene oxide (25 moles) adduct of castor oil, and propylene oxide (4 moles) ethylene oxide (6 mole) adduct of stearyl alcohol. In the above and hereinafter, POE and PEG respectively indicate polyoxyethylene and polyethyleneglycol and the numeral inside the parentheses which follow indicates the molar number of addition.

Preferable surfactants of another kind to be used together with the aforementioned aliphatic diethanol amides and polyoxyalkylene modified silicones according to the present invention include alkyl phosphate salts shown by the following general formula (Formula (C)), quaternary ammonium salts shown by the following general formula (Formula (D)) and alkyl imidazolinium salts shown by the following general formula (Formula (E)):

$$(R^1O)_a-\overset{\overset{\displaystyle O}{\|}}{P}-(OM)_b \qquad \text{(C)}$$

where $R^1$ is alkyl or alkenyl group with 12–18 carbon atoms, M is Na, K or ammonium, and a and b are integers equal to or greater than such that $a+b=3$;

$$\left(\begin{array}{c} R^1 \quad R^2 \\ N \\ R^2 \quad R^2 \end{array}\right)^{\oplus} .X^{\ominus} \qquad \text{(D)}$$

and

-continued (E)

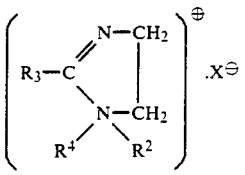

where $R^1$ is alkyl or alkenyl group with 12–18 carbon atoms, $R^2$ is H, alkyl or hydroxyalkyl group with 1–2 carbon atoms or $R^1$, $R^3$ is alkyl or alkenyl group with 11–17 carbon atoms, $R^4$ is $C_2H_4OH$, $C_2H_4NH_2$, $C_2H_4NHCOCH_3$ or $C_2H_4NHCOR^3$, and X is halogen, residue of organic or inorganic acid or alkyl sulfate or alkyl phosphate with 1–2 carbon atoms. It is also effective to use such (alkyl phosphate, quaternary ammonium and alkyl imidazolinium) salts together with the aforementioned aliphatic diethanol amides, polyoxyalkylene modified silicones and nonionic surfactants of the present invention.

The salts of the aforementioned group are capable of improving the processability of non-woven sheets during their production without adversely affecting the fluid-permeability and durability of aliphatic diethanol amides and polyoxyalkylene modified silicones. In particular, antistatic characteristics, card-processability and uniformity of web during a web-formation process can be obtained with them. The limiting conditions presented above with respect to these salts are important, for example, in that those with smaller alkyl or alkenyl groups than specified above adversely affect the durability of aliphatic diethanol amides and polyoxyalkylene modified silicones and that those with larger alkyl or alkenyl groups than specified above tend to obstruct the fluid-permeability of aliphatic diethanol amides and polyoxyalkylene modified silicones. Examples of ammonium in Formula (C) include $NH_4$, $NH(CH_3)_3$, $NH(C_2H_5)_3$, $NH_2(CH_2CH_2OH)_2$ and $NH(CH_2CH_2OH)_3$.

Composite fibers with a sheath part of polyethylene polymer and a core part of polypropylene or polyester fibers are representative examples of polyolefin fibers to which the fluid-permeable agents of the present invention are applicable but the present invention is by no means limited to application to such fibers. The agents of the present invention are also applicable not only to composite fibers in general with a sheath part of polyolefin polymer and a core part of another polymer with a different melting point but also to polyethylene fibers, polypropylene fibers and other copolymer fibers not by composite spinning.

The agents of the present invention should preferably be applied to such polyolefin fibers generally at the rate (with respect to the fibers) of 0.05–0.7wt% and more preferably 0.1–0.5wt%. Methods of application include dipping, spraying and the roller-touch method. The polyolefin fibers to which an agent has been applied is dried for production of non-woven sheets by card processing and heat bonding.

In what follows, examples of tests and their results are presented to further describe the present invention but it goes without saying that these examples are not intended to limit the scope of the invention. For testing, agents inclusive of seven test examples and six comparison examples were prepared with constituents selected as follows and shown in Table 1. Samples each with 0.2wt% of one of these agents were prepared by dipping composite fibers of 2 denier×51mm cut length with sheath part of polyethylene and core part of polyester in 1.0% solution of each of the agents listed in Table 1 for two minutes at 40° C., thereafter squeezing to 20wt% and hot air drying for 60 minutes at 60° C.

Antistatic characteristics of the samples were evaluated by keeping them for 24 hours under temperature-humidity conditions of 25° C. and 40%RH and measuring the generated static charge as they were passed through an opener and a roller card under these conditions such that the web weight became $24g/m^2$.

For evaluation of fluid-permeability, non-woven sheet samples were prepared by cutting the aforementioned card web to 10cm×10cm and thermally testing for 30 seconds by a heater plate of 130° C. After these sheet samples were conditioned for 24 hours within a chamber at 20° C. and 60%RH, they were placed on a horizontal plate, water drops of 0.4ml were dropped from a height of 10mm and the time required for each water drop to be completely absorbed was measured.

For evaluating durability, after 80ml of ion exchange water was sprayed over the sample to be passed therethrough, the samples were hot air dried for 90 minutes at 40° C. and the evaluation of fluid-permeability was repeated. If the measured time was 60 seconds or less, it was recorded and the process described above was repeated. The total number of repetitions was also recorded.

Table 2, which summarizes the results of these tests, clearly shows that the agents according to the present invention can provide superior fluid-permeability and durability to non-woven sheets made from polyolefin fibers and improve processability of such non-woven sheets during their production.

TABLE 1

| Classification | Component | Content (wt %) |
|---|---|---|
| Example 1 | $C_{17}H_{35}CON(C_2H_4OH)_2$ | 30 |
| | $C_{11}H_{23}CON(C_2H_4OH)_2$ | 20 |
| | Silicone of Formula (B) with x = 3, y = 22, a = 23, b = 0, $R^2 = C_4H_9$ | 50 |
| Example 2 | Aliphatic diethanol amide in Example 1 (upper row) | 50 |
| | Silicone of Formula (B) with x = 2, y = 20, a = 45, b = 36, $R^2$ = H | 45 |
| | 1-(2-hydroxyethyl)-1-ethyl-2-pentadecyl-2-imidazolinum-ethylsulfate | 5 |
| Example 3 | Aliphatic diethanol amide in Example 2 | 50 |
| | Silicone of Formula (B) with x = 6, y = 52, a = 14, b = 25, $R^2$ = H | 30 |
| | Potassium cetyl phosphate | 20 |
| Example 4 | Aliphatic diethanol amide in Example 2 | 70 |
| | Silicone of Formula (B) with x = 3, y = 22, a = 23, b = 0, $R^2 = C_4H_9$ | 20 |

TABLE 1-continued

| Classification | Component | Content (wt %) |
|---|---|---|
| | Potassium cetyl phosphate | 10 |
| Example 5 | | |
| | Apliphatic diethanol amide in Example 2 | 60 |
| | Silicone in Example 4 | 15 |
| | Sorbitan monopalmitate | 10 |
| | Ethylene oxide 25 mole adduct of hydrogenated castor oil | 15 |
| Example 6 | | |
| | Aliphatic diethanol amide in Example 2 | 55 |
| | Silicone in Example 4 | 15 |
| | Ethylene oxide 10 mole adduct of stearic amide | 20 |
| | Potassium stearyl phosphate | 10 |
| Example 7 | | |
| | Aliphatic diethanol amide in Example 2 | 65 |
| | Silicone in Example 4 | 10 |
| | Ethylene oxide 7 mole adduct of stearic amide | 20 |
| | 1-(2-hydroexyethyl)-1-ethyl-2-pentadecyl-2-imidazolinium ethylsulfate | 5 |
| Comparison 1 | Potassium stearyl phosphate | 100 |
| Comparison 2 | Aliphatic diethanol amide in Example 1 (first line) | 70 |
| | Aliphatic diethanol amide in Example 1 (second line) | 30 |
| Comparison 3 | Aliphatic diethanol amide in Example 2 | 60 |
| | Ethylene oxide 7 mole adduct of stearic amide | 40 |
| Comparison 4 | Silicone in Example 4 | 100 |
| Comparison 5 | Aliphatic diethanol amide in Example 2 | 30 |
| | Silicone in Example 4 | 60 |
| | Potassium cetyl phosphate | 10 |
| Comparison 6 | Aliphatic diethanol amide in Example 2 | 30 |
| | Silicone in Example 4 | 30 |
| | Ethylene oxide 7 mole adduct of stearic amide | 20 |
| | Potassium cetyl phosphate | 20 |

TABLE 2

| | static Charge (kV) | Permeability (sec) | Durability: Permeability After Each Use (sec) Once | Twice | Thrice | Total Number of Repetitions |
|---|---|---|---|---|---|---|
| Example | | | | | | |
| 1 | −0.3 | 2 | 4 | 4 | 5 | 15 |
| 2 | −0.1 | 2 | 3 | 4 | 5 | 16 |
| 3 | ±0.0 | 1 | 2 | 2 | 4 | 15 |
| 4 | −0.3 | 1 | 1≧ | 1 | 1 | 20 |
| 5 | −0.3 | 2 | 2 | 3 | 3 | 16 |
| 6 | −0.1 | 1≧ | 1≧ | 1≧ | 1 | 20 |
| 7 | −0.1 | 1 | 1 | 2 | 2 | 18 |
| Comparison | | | | | | |
| 1 | +1.0 | 60≦ | — | — | — | 0 |
| 2 | −0.4 | 6 | 24 | 41 | 49 | 4 |
| 3 | −0.5 | 20 | 19 | 21 | 26 | 7 |
| 4 | −0.4 | 4 | 5 | 6 | 7 | 11 |
| 5 | −0.5 | 4 | 8 | 14 | 20 | 7 |
| 6 | −0.3 | 23 | 41 | 60≦ | — | 1 |

What is claimed is:

1. A fluid-permeable agent for providing fluid-permeability to non-woven sheets of polyolefin fibers, said agent being characterized as containing 50–95 wt% of aliphatic diethanol amide shown by Formula (A) given below and 5–50 wt% of polyoxyalkylene modified silicone shown by Formula (B) given below:

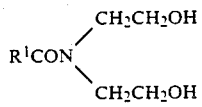

(A)

where $R^1$ is alkyl or alkenyl group with 11–17 carbon atoms; and

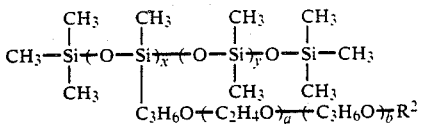

(B)

where x is an integer in the range of 1–10, y is an integer in the range of 7–100, a is an integer equal to or greater than 5, b is an integer equal to or less than 95, (a+b) is an integer equal to or less than 100 and $R^2$ is H or alkyl group with 1–12 carbon atoms.

2. The agent of claim 1 characterized as containing 50–75 wt% of aliphatic diethanol amide shown by said Formula (A), 5–45 wt% of polyoxyalkylene modified silicone shown by said Formula (B) and 5–30 wt% of a surfactant.

3. The agent of claim 2 wherein said surfactant is a nonionic surfactant having alkyl or alkenyl group with 11–22 carbon atoms and 3–10 moles of ethylene or propylene oxide added per functional group thereof.

4. The agent of claim 2 wherein said surfactant is alkyl phosphate salt shown by Formula (C) given below:

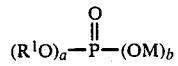

(C)

where $R^1$ is alkyl or alkenyl group with 12–18 carbon atoms, M is Na, K or ammonium, and a and b are integers equal to or greater than 1 such that a+b=3.

5. The agent of claim 2 wherein said surfactant is quaternary ammonium salt shown by Formula (D) given below:

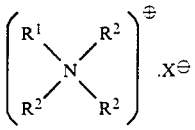

(D)

where $R^1$ is alkyl or alkenyl group with 12–18 carbon atoms, $R^2$ is H, alkyl or hydroxyalkyl group with 1–2 carbon atoms or $R^1$, and X is halogen, residue of organic or inorganic acid, or alkyl sulfate or alkyl phosphate with 1–2 carbon atoms.

6. The agent of claim 2 wherein said surfactant is alkyl imidazolinium salt shown by Formula (E) shown below:

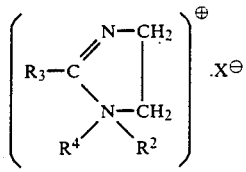

(E)

where $R^2$ is H, alkyl or hydroxyalkyl group with 1–2 carbon atoms, or alkyl or alkenyl group with 12–18 carbon atoms, X is halogen, residue of organic or inorganic acid, or alkyl sulfate or alkyl phosphate with 1–2 carbon atoms, $R^3$ is alkyl or alkenyl group with 11–17 carbon atoms and $R^4$ is $C_2H_4OH$, $C_2H_4NH_2$, $C_2H_4NHCOCH_3$ or $C_2H_4NHCOR^3$.

7. A method of providing fluid-permeability to non-woven sheet of polyolefin fibers, said method comprising the steps of applying a fluid-permeable agent to polyolefin spun fibers at a rate of 0.1–0.5wt% with respect to said fibers and thereafter using said fibers for production of non-woven sheets, said agent being characterized as containing 50–95 wt% of aliphatic diethanol amide shown by Formula (A) given below and 5–50 wt% of polyoxyalkylene modified silicone shown by Formula (B) given below:

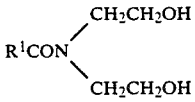

(A)

where $R^1$ is alkyl or alkenyl group with 11–17 carbon atoms; and

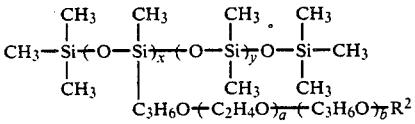

(B)

where x is an integer in the range of 1–10, y is an integer in the range of 7–100, a is an integer equal to or greater than 5, b is an integer equal to or less than 95, (a+b) is an integer equal to or less than 100 and $R^2$ is H or alkyl group with 1–12 carbon atoms.

8. The method of claim 7 wherein said agent is characterized as containing 50–75 wt% of aliphatic diethanol amide shown by said Formula (A), 5–45 wt% of polyoxyalkylene modified silicone shown by said Formula (B) and 5–30 wt% of a surfactant.

9. The method of claim 8 wherein said surfactant is a nonionic surfactant having alkyl or alkenyl group with 11–22 carbon atoms and 3–10 moles of ethylene or propylene oxide added per functional group thereof.

10. The method of claim 8 wherein said surfactant is alkyl phosphate salt shown by Formula (C) given below:

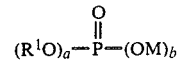

(C)

where $R^1$ is alkyl or alkenyl group with 12–18 carbon atoms, M is Na, K or ammonium, and a and b are integers equal to or greater than such that a+b=3.

11. The method of claim 8 where said surfactant is quaternary ammonium salt shown by Formula (D) given below:

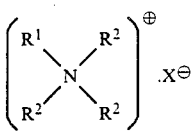

(D)

where $R^1$ is alkyl or alkenyl group with 12–18 carbon atoms, $R^2$ is H, alkyl or hydroxyalkyl group with 1–2 carbon atoms or $R^1$, and X is halogen, residue of organic or inorganic acid, or alkyl sulfate or alkyl phosphate with 1–2 carbon atoms.

12. The method of claim 8 wherein said surfactant is alkyl imidazolinium salt shown by Formula (E) shown below:

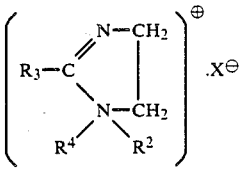

(E)

where $R^2$ is H, alkyl or hydroxyalkyl group with 1–2 carbon atoms, or alkyl or alkenyl group with 12–18 carbon atoms, X is halogen, residue of organic or inorganic acid, or alkyl sulfate or alkyl phosphate with 1–2 carbon atoms, $R^3$ is alkyl or alkenyl group with 11–17 carbon atoms and $R^4$ is $C_2H_4OH$, $C_2H_4NH_2$, $C_2H_4NHCOCH_3$ or $C_2H_4NHCOR^3$.

* * * * *

UNITED STATES PATENT AND TRADEMARK OFFICE

CERTIFICATE OF CORRECTION

PATENT NO. : 4,921,622

DATED : May 1, 1990

INVENTOR(S) : TOMOHIRO KATO, YOSHIO TAKASU, MAKOTO MINAFUJI

It is certified that error appears in the above-identified patent and that said Letters Patent is hereby corrected as shown below:

Column 10, Claim 10, line 23, after "greater than" insert --1--.

Signed and Sealed this

Seventeenth Day of March, 1992

*Attest:*

HARRY F. MANBECK, JR.

*Attesting Officer*

*Commissioner of Patents and Trademarks*